US010184437B2

(12) United States Patent
Pohlmann et al.

(10) Patent No.: US 10,184,437 B2
(45) Date of Patent: Jan. 22, 2019

(54) ARRANGEMENT WITH A FUEL DISTRIBUTOR AND MULTIPLE FUEL INJECTION VALVES

(71) Applicant: Robert Bosch GmbH, Stuttgart (DE)

(72) Inventors: Jens Pohlmann, Bietigheim-Bissingen (DE); Michael Fischer, Niefern-Oeschelbronn (DE); Matthias Maess, Boeblingen (DE); Goekhan Guengoer, Eberdingen (DE); Martin Riemer, Untergruppenbach (DE); Markus Friedrich, Moosburg (DE); Andreas Rehwald, Bietigheim-Bissingen (DE); Michael Mayer, Wannweil (DE); Dietmar Uhlenbrock, Stuttgart (DE); Venkatesh Kannan, Novi, MI (US)

(73) Assignee: ROBERT BOSCH GMBH, Stuttgart (DE)

( * ) Notice: Subject to any disclaimer, the term of this patent is extended or adjusted under 35 U.S.C. 154(b) by 378 days.

(21) Appl. No.: 14/396,607

(22) PCT Filed: Apr. 2, 2013

(86) PCT No.: PCT/EP2013/056850
§ 371 (c)(1),
(2) Date: Oct. 23, 2014

(87) PCT Pub. No.: WO2013/160068
PCT Pub. Date: Oct. 31, 2013

(65) Prior Publication Data

US 2015/0083082 A1 Mar. 26, 2015

(30) Foreign Application Priority Data

Apr. 26, 2012 (DE) ..... 10 2012 206 890

(51) Int. Cl.
*F02M 55/04* (2006.01)
*F02M 55/00* (2006.01)
(Continued)

(52) U.S. Cl.
CPC ..... *F02M 55/04* (2013.01); *F02M 55/005* (2013.01); *F02M 55/025* (2013.01);
(Continued)

(58) Field of Classification Search
None
See application file for complete search history.

(56) References Cited

U.S. PATENT DOCUMENTS 4,284,215 A 8/1981 Nye
5,074,269 A 12/1991 Herbon et al.
(Continued)

FOREIGN PATENT DOCUMENTS

CN 101568706 A 10/2009
EP 2 034 171 3/2009
(Continued)

OTHER PUBLICATIONS

International Search Report for PCT/EP2013/056850, dated Jul. 27, 2013.

*Primary Examiner* — Hung Q Nguyen
*Assistant Examiner* — Brian P Monahon
(74) *Attorney, Agent, or Firm* — Norton Rose Fulbright US LLP; Gerard Messina

(57) ABSTRACT

A fuel injection system has a fuel distributor and multiple fuel injection valves each disposed on a cup of the fuel distributor. At least one injection valve is mounted on the associated cup by way of at least one holding element. An abutment surface is provided on the outer side of the cup. A support surface is configured on the underside of the cup. The holding element is moreover configured as a holding
(Continued)

clamp. An abutment surface is provided on an outer side of the fuel injection valve. The holding clamp engages on the one hand behind the abutment surface of the cup and on the other hand behind the abutment surface of the fuel injection valve. The holding clamp furthermore pushes the fuel injection valve toward the support surface.

15 Claims, 6 Drawing Sheets

(51) Int. Cl.
*F02M 55/02* (2006.01)
*F02M 61/14* (2006.01)

(52) U.S. Cl.
CPC ..... *F02M 61/14* (2013.01); *F02M 2200/09* (2013.01); *F02M 2200/803* (2013.01); *F02M 2200/8023* (2013.01); *F02M 2200/853* (2013.01); *F02M 2200/855* (2013.01)

(56) References Cited

U.S. PATENT DOCUMENTS 5,301,647 A 4/1994 Lorraine
6,148,797 A 11/2000 Gmelin
7,334,571 B1 2/2008 Beardmore
7,406,946 B1 * 8/2008 Watanabe ..... F02M 55/005 123/456
8,813,722 B2 * 8/2014 Harvey ..... F02M 55/005 123/456
2002/0100456 A1 * 8/2002 Panasuk ..... F02M 55/004 123/456
2002/0108660 A1 * 8/2002 Braun ..... B29C 45/1642 138/30
2002/0148446 A1 * 10/2002 Gmelin ..... F02M 61/14 123/470
2003/0080556 A1 * 5/2003 Kilgore ..... F02M 55/005 285/189
2007/0163545 A1 * 7/2007 Beardmore ..... F02M 55/025 123/456
2007/0251498 A1 * 11/2007 Ricco ..... F02M 47/027 123/445
2009/0050113 A1 * 2/2009 Liskow ..... F02M 61/14 123/470
2009/0064972 A1 * 3/2009 Abe ..... F02M 55/004 123/456
2009/0229576 A1 * 9/2009 Biasci ..... F02M 55/025 123/470
2010/0031928 A1 * 2/2010 Giorgetti ..... F02M 53/02 123/470
2010/0071664 A1 * 3/2010 Hunt ..... F02M 55/025 123/456
2010/0154746 A1 * 6/2010 Fischer ..... F02M 61/14 123/456
2010/0258085 A1 * 10/2010 Giorgetti ..... F02M 55/02 123/470
2010/0264231 A1 * 10/2010 Di Domizio ..... F02M 55/02 239/5
2010/0300409 A1 * 12/2010 Harvey ..... F02M 61/14 123/470
2011/0017175 A1 * 1/2011 Grandi ..... F02M 55/025 123/470
2011/0186015 A1 * 8/2011 Hanjagi ..... F02M 37/0041 123/457
2011/0247591 A1 * 10/2011 Holt ..... F02M 61/14 123/470
2012/0031375 A1 * 2/2012 Fischer ..... F02M 61/14 123/445
2012/0204837 A1 * 8/2012 Harvey ..... F02M 55/02 123/469
2013/0284152 A1 * 10/2013 Fischer ..... F02M 55/025 123/470
2015/0136086 A1 * 5/2015 Pohlman ..... F02M 61/14 123/456

FOREIGN PATENT DOCUMENTS

EP 2 101 097 9/2009
EP 2 151 572 2/2010
GB 2 024 324 1/1980
WO 03/006818 A1 1/2003

* cited by examiner

ARRANGEMENT WITH A FUEL DISTRIBUTOR AND MULTIPLE FUEL INJECTION VALVES

BACKGROUND OF THE INVENTION

1. Field of the Invention

The present invention relates to an assemblage, in particular to a fuel injection system for high-pressure injection in internal combustion engines, having a fuel distributor and multiple fuel injection valves.

2. Description of the Related Art

Published European patent application document EP 2 151 572 A2 discloses a fuel distributor rail having multiple fuel injection valves. In order to connect the fuel injection valves to the fuel distributor rail, a shoulder is placed around an undercut on the respective fuel injection valve, tongues being configured on the shoulder. An injector connector on the fuel distributor rail has a cylindrical body into which the upper end of the fuel injection valve is fitted. A retaining bracket is fitted over the cylindrical body, and recesses in the retaining bracket interact with the tongues of the shoulder. Mounting of the associated fuel injection valve on the fuel distributor rail is thereby accomplished.

The configuration known from Published European patent application document EP 2 151 572 A2 has the disadvantage that during operation, the fuel distributor rail is excited to vibrate in the audible frequency range. This occurs principally as a result of noise sources in the fuel injection valves. The solid-borne sound propagates from the fuel injection valves via the cylindrical bodies of the injector connectors, the fuel distributor rail and rail holder, or the like, to the attachment structure, from which obtrusive noise is radiated. This obtrusive noise can in some circumstances even penetrate into the interior of the vehicle. The cylinder head can serve as an attachment structure.

BRIEF SUMMARY OF THE INVENTION

The assemblage according to the present invention has the advantage of enabling decoupling or damping, in terms of vibration engineering, between the fuel injection valves and the fuel distributor. It results in particular in the advantage that noise emissions which do occur can be decreased.

The assemblage is especially suitable for internal combustion engines for direct gasoline injection. The fuel distributor can be configured here in particular as a fuel distributor rail. The fuel distributor can serve on the one hand to distribute fuel to multiple fuel injection valves, in particular high-pressure injection valves. The fuel distributor can serve on the other hand as a common fuel reservoir for the fuel injection valves. The fuel injection valves are connected to the fuel distributor, and inject the fuel necessary for the combustion process under high pressure preferably directly into the combustion chambers of the internal combustion engine. The fuel is compressed via a high-pressure pump, and conveyed in a controlled quantity via a high-pressure line into the fuel distributor.

The fuel distributor can be mounted to an attachment structure, in particular to a cylinder head of the internal combustion engine, directly or also via spacing sleeves and optionally further connecting elements.

Advantageously, the fuel injection valves can be mounted on the cups as suspended fuel injection valves. The holding element for connection can form a snap-lock connection on the one hand with the cup and on the other hand with the fuel injection valve. A partially annular setback of the cup can be configured in the form of a lug or a collar. Advantageously, a collar is correspondingly provided on the fuel injection valve. The quasi-static forces can thereby be transferred for mounting. At the same time, the holding element performs the function such that the relative deflection of the fuel injection valve with respect to the associated cup under the action of operating forces remains below a defined limit value, thereby protecting, for example, an O-ring seal or a Teflon ring seal from damage and wear.

It is advantageous that the abutment surface of the cup and the abutment surface of the fuel injection valve face away from one another. It is further advantageous that the abutment surface of the cup and the support surface of the cup face away from one another. With this embodiment the holding clamp can advantageously be embodied as a U-shaped holding clamp. Upon assembly, the holding clamp can then, so to speak, be clipped onto the cup and onto the fuel injection valve that is inserted into the cup. A reliable connection is thereby formed, and assembly can be carried out in simple fashion.

It is also advantageous that an at least partially annular setback of the cup is configured on the outer side of the cup, at which setback the abutment surface of the cup is configured. The at least partially annular setback can be configured as an annular setback or as a partially annular setback. It is correspondingly advantageous that an at least partially annular collar is configured on the fuel injection valve, at which collar the abutment surface of the fuel injection valve and a support surface facing toward the support surface of the cup are configured. The at least partially annular collar can be configured as a partially annular collar or as an annular collar. In the case of a partially annular configuration of the setback of the cup or collar of the fuel injection valve, multiple respective setbacks or collars can also be provided, on which multiple holding clamps are mounted. The number of holding elements, configured as holding clamps, that mount a fuel injection valve on an associated cup of the fuel distributor can be selected with reference to the particular application instance.

It is further advantageous that at least one of the composite damping elements has a bent outer segment that fits around an outer side of the collar. This reliably prevents contact between the outer side of the collar and the holding clamp. It is correspondingly advantageous that at least one of the composite damping elements is configured as an at least approximately planar composite damping element, and projects beyond an outer side of the collar. This guarantees a certain distance between the holding clamp and the outer side of the collar.

Advantageously, at least one of the composite damping elements is configured as an annular or partially annular composite damping element. Homogeneous impingement upon the composite damping element can thereby be achieved, thus resulting in effective damping over the service life. A circular configuration of the composite damping elements is particularly advantageous in this regard. If this is not possible, for example for assembly reasons in order to avoid a plug connector, then a partially annular contour, for example in the form of a C-shaped ring, can also be selected.

Advantageously, the composite damping element is disposed between the support surface of the fuel injection valve and the support surface of the cup. It is also advantageous that a first composite damping element is disposed between the fuel injection valve and the support surface of the cup, and that a second composite damping element is disposed between the abutment surface of the fuel injection valve and the holding clamp. Direct metal-to-metal contact is avoided with this configuration, by the fact that a composite damping element is always interposed in the mechanical energy transfer path. This results in particularly effective vibration damping.

It is furthermore advantageous that the holding clamp is configured from a composite element having at least one metallic metal layer and at least one damping layer. The holding clamp can then be manufactured by reshaping the composite sheet. The composite sheet can have, for example, a layered structure made up of two metal layers and one elastically deformable layer, in particular an elastomer layer, located therebetween. The construction for vibration decoupling can thereby also be simplified if applicable, the holding clamp made from the composite sheet enabling the insulating effect as a result of its inherent component damping. Depending on the application, however, the holding clamp can also be made from a rigid material.

Advantageously, the composite damping element is configured from at least one metal layer and at least one damping layer. Numerous variants, which differ inter alia in terms of the number of layers, are conceivable here.

DETAILED DESCRIPTION OF THE INVENTION

Figure 1:
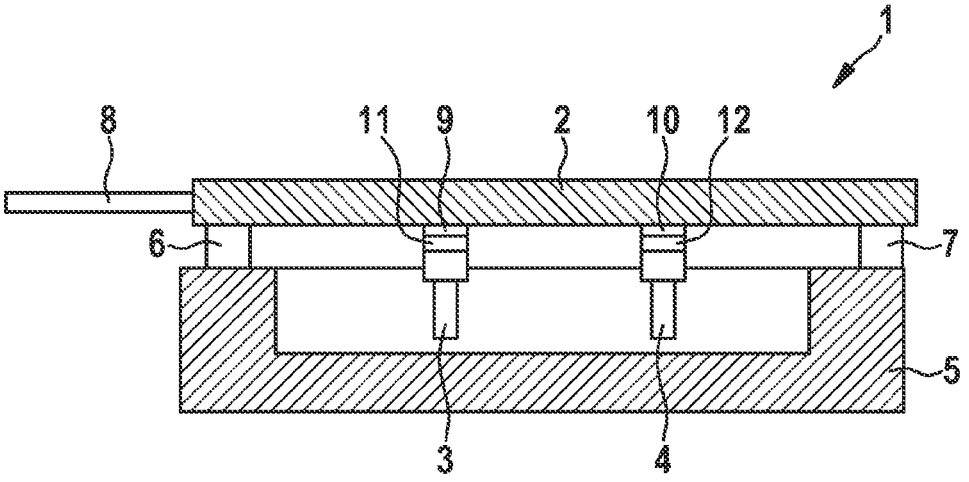
FIG. 1 is a schematic sectioned depiction, in part, of an assemblage having a fuel distributor and multiple fuel injection valves, in accordance with a first exemplifying embodiment of the invention.

FIG. 1 shows an assemblage 1 having a fuel distributor 2 and multiple fuel injection valves 3, 4. Fuel distributor 2 can be configured in particular as a fuel distributor rail. Fuel distributor 2 serves to store fuel under high pressure, and to distribute fuel to the multiple fuel injection valves 3, 4. In order to simplify the depiction, only two fuel injection valves 3, 4 are depicted in this exemplifying embodiment. The number of fuel injection valves 3, 4 that are connected to fuel distributor 2 depends on the number of cylinders of the internal combustion engine. Fuel distributor 2 is connected in suitable fashion to an attachment structure 5, in particular a cylinder head 5. Fuel distributor 2 can also be attached via spacing sleeves or via further connecting elements 6, 7. Also provided is a high-pressure line 8 that is connected to fuel distributor 2. High-pressure line 8 serves to deliver fuel under high pressure into fuel distributor 2.

Cups 9, 10 are provided on fuel distributor 2. Fuel injection valves 3, 4 are connected to cups 9, 10. Composite damping elements 11, 12 that decouple fuel injection valves 3, 4 from cups 9, 10 are provided. FIG. 1 shows in this context a schematic assemblage in which composite damping elements 11, 12 are interposed between fuel injection valves 3, 4 and the associated cups 9, 10. The configuration of the decoupling and connection between fuel injection valves 3, 4 and the associated cup 9, 10 is described further with reference to FIG. 2.

Figure 2:
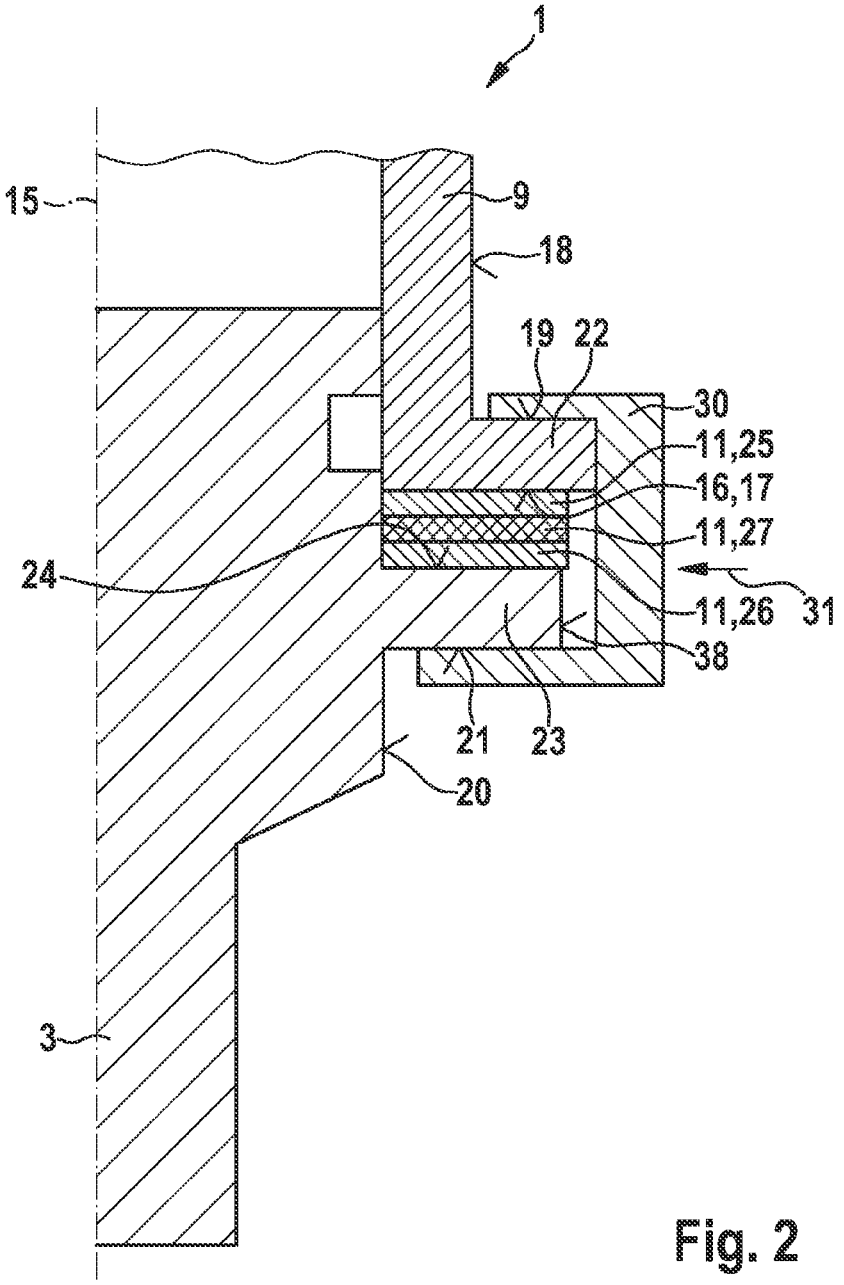
FIG. 2 is a schematic sectioned depiction, in part, of a fuel injection valve and a cup of the fuel distributor of the assemblage of the first exemplifying embodiment depicted in FIG. 1.

FIG. 2 schematically depicts, in part, fuel injection valve 3 and cup 9 of fuel distributor 2 of assemblage 1 depicted in FIG. 1 in accordance with the first exemplifying embodiment. Fuel injection valve 3 has a longitudinal axis 15. Cup 9 has an underside 16 that, in this exemplifying embodiment, forms a support surface 17. Support surface 17 can, however, also be configured differently on underside 16. Provided on an outer side 18 of cup 9 is an abutment surface that, in this exemplifying embodiment, is oriented perpendicularly to longitudinal axis 15. In addition, an abutment surface 21, which in this exemplifying embodiment is oriented perpendicularly to longitudinal axis 15, is configured on an outer side 20 of fuel injection valve 3. Abutment surface 19 of cup 9 and abutment surface 21 of fuel injection valve 3 face away from one another.

In this exemplifying embodiment, an annular or partially annular setback 22 of cup 9 is configured on outer side 18 of cup 9, at which setback abutment surface 19 of cup 9 is configured. Also configured on fuel injection valve 3 is an annular or partially annular collar 23 at which abutment surface 21 of fuel injection valve 3 is configured. A support surface is furthermore configured on collar 23. In this exemplifying embodiment, support surface 17 of cup 9 and support surface 24 of fuel injection valve 3 are each oriented perpendicularly to longitudinal axis 15. In addition, support surface 17 of cup 9 and support surface 24 of fuel injection valve 3 face toward one another.

Composite damping element 11 is disposed between support surface 17 of cup 9 and support surface 24 of fuel injection valve 3. In this exemplifying embodiment, composite damping element 11 is configured as a flat composite damping element 11. Composite damping element 11 has metal layers 25, 26 that are each based on a metallic material. A damping layer 27 of composite damping element 11 is provided between metal layers 25, 26. Damping layer 27 can be configured from a rubber, in particular a natural rubber or a synthetic rubber. Damping layer 27 can be connected to metal layers 25, 26 in particular by vulcanizing. This makes possible a multi-layer configuration of composite damping element 11. Direct contact between metal layers 25, 26 is thereby prevented by damping layer 27. Direct metal-to-metal contact is thus prevented at the interface between cup 9 and fuel injection valve 3, since damping layer 27 is disposed in that path, as also depicted schematically with reference to FIG. 1.

Assemblage 1 furthermore has a holding element 30 configured as a holding clamp 30. In this exemplifying embodiment, holding clamp 30 is made from a rigid material, in particular a metal. Holding clamp 30 engages on the one hand behind abutment surface 19 of cup 9, and on the other hand behind abutment surface 21 of fuel injection valve 3. Holding clamp 30 thereby pushes collar 30 of fuel injection valve 3 against underside 16 of cup 9. Holding clamp 30 can, for example, be clipped in an assembly direction 31 onto setback 22 of cup 9 and onto collar 23 of fuel injection valve 3 when fuel injection valve 3 is fitted partly into cup 3 in its final position. A certain preload can be exerted in this context onto composite damping element 11 and thus onto damping layer 27.

Acoustic decoupling can thus be implemented by way of composite damping element 11. The connection of fuel injection valve 4 to fuel distributor 2 is configured correspondingly.

A partial decoupling is implemented in the case of the first exemplifying embodiment described with reference to FIGS. 1 and 2, since metallic contacts exist between fuel injection valve 3 and cup 9 by way of the metallic holding clamp 30. Decoupling and damping in terms of vibration engineering can be achieved here without infringing upon the other requirements. The result is a reduction in noise emissions from assemblage 1, and optionally from components connected to assemblage 1.

Figure 3:
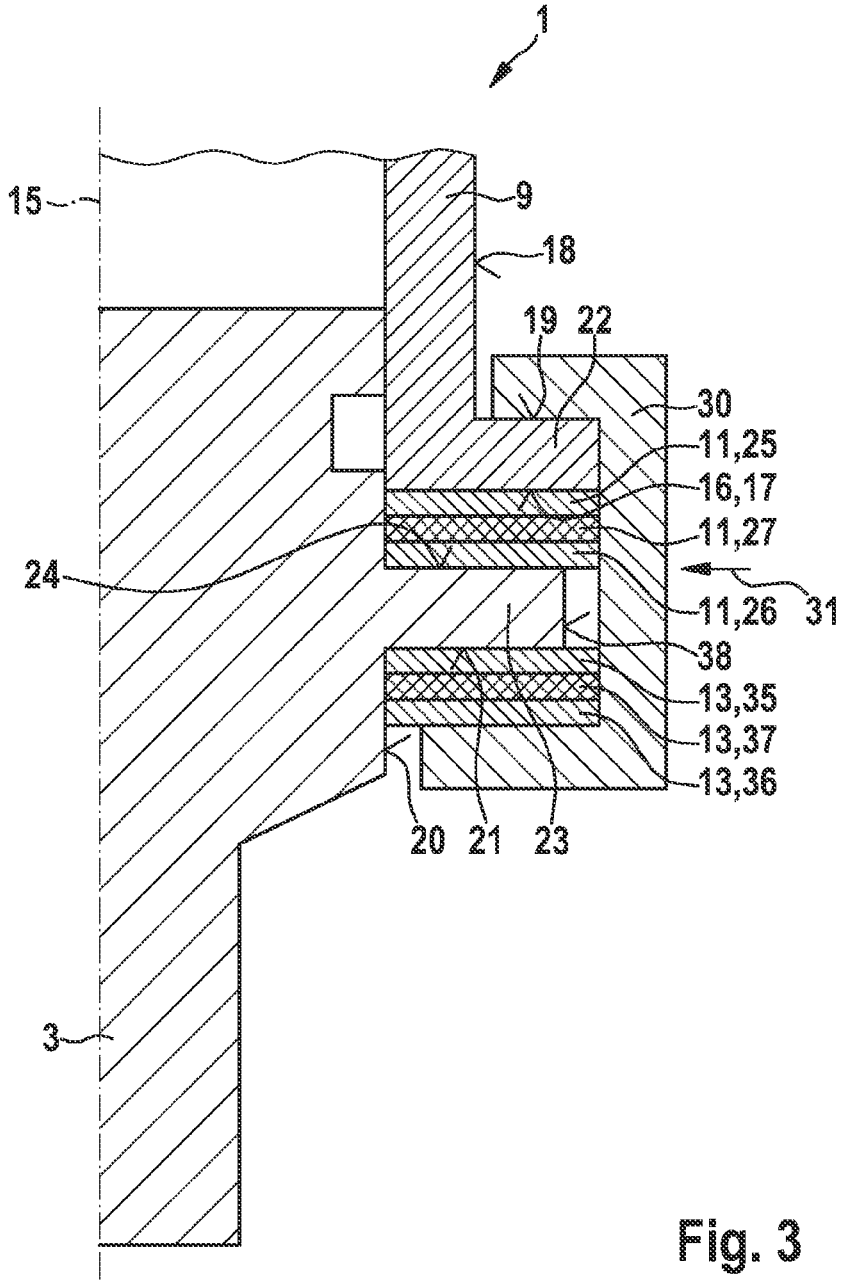
FIG. 3 shows the portion depicted in FIG. 2 of an assemblage in accordance with a second exemplifying embodiment of the invention.

FIG. 3 shows the segment depicted in FIG. 2 of an assemblage 1 in accordance with a second exemplifying embodiment of the invention. In this exemplifying embodiment a further composite damping element 13 is disposed between abutment surface 21 of collar 23 of fuel injection valve 3 and holding clamp 30. Composite damping element 13 has a configuration corresponding to that of composite damping element 11. Composite damping element 13 encompasses metal layers 35, 36 and a damping layer 37 that is disposed between metal layers 35, 36. Metal-to-metal contacts, through which transfer of solid-borne sound is still possible, are completely prevented with this configuration. No exclusively metallic contacts therefore exist, and complete insulation is created by the fact that, in contrast to the second exemplifying embodiment described with reference to FIG. 2, a composite damping element 13 is also provided or inserted between holding clamp 30 and collar 23.

With this configuration, a first of the composite damping elements 11, 13, namely composite damping element 11, is therefore disposed between fuel injection valve 3 and support surface 17 of cup 9, and a second of the composite damping elements 11, 13, namely composite damping element 13, is disposed between abutment surface 21 of fuel injection valve 3 and holding clamp 30. In addition, the two composite damping elements 11, 13 are configured as planar composite damping elements 13. Composite damping elements 13 each project beyond an outer side 38 of collar 23 of fuel injection valve 3. This ensures that holding clamp 30 is always spaced away from outer side 38 of collar 23.

Figure 4:
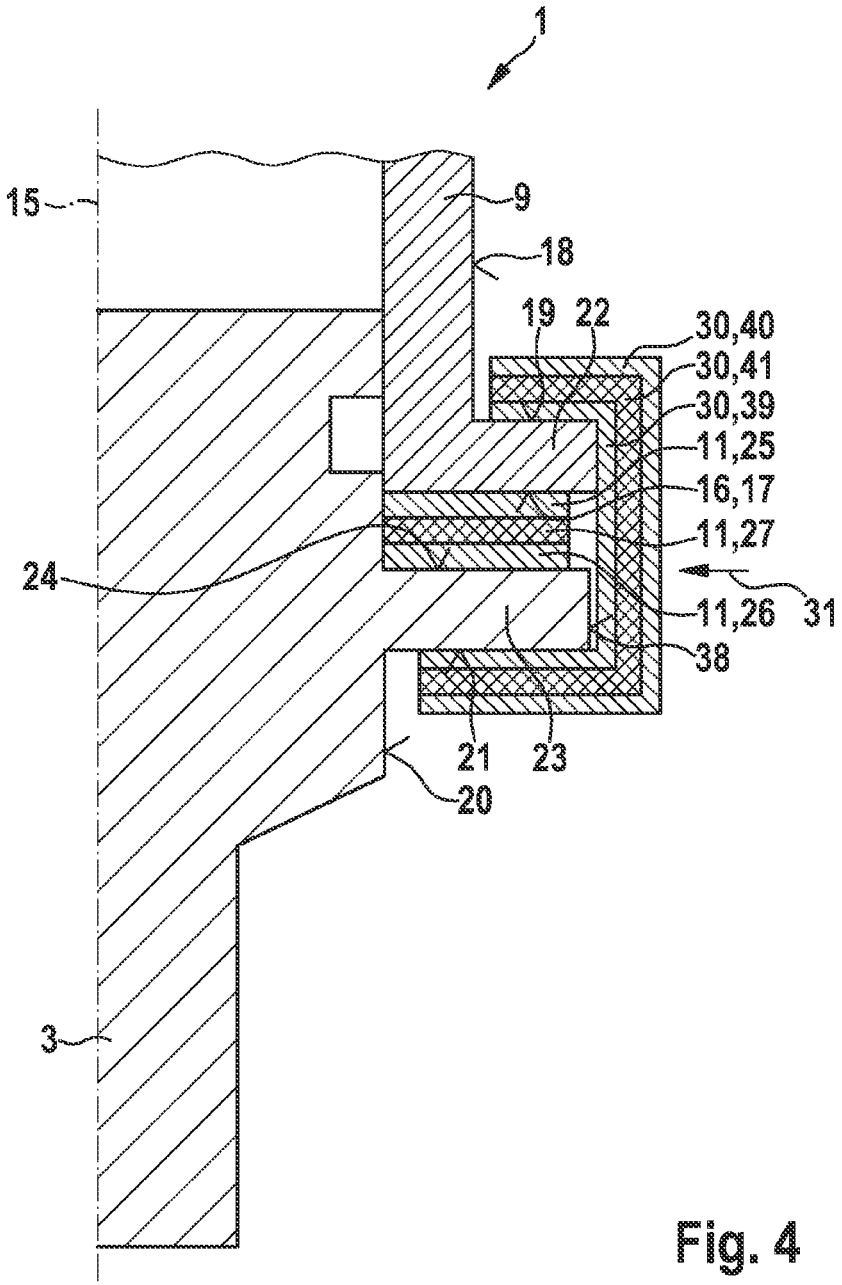
FIG. 4 shows the portion depicted in FIG. 2 of an assemblage in accordance with a third exemplifying embodiment of the invention.

FIG. 4 shows the portion depicted in FIG. 2 of an assemblage 1 in accordance with a third exemplifying embodiment. In this exemplifying embodiment a composite damping element 11 is disposed between support surface 24 of collar 23 and support surface 17 of cup 9. In addition, holding clamp 30 is configured from a composite sheet having metal layers 39, 40 and a damping layer 41 disposed between metal layers 39, 40. Holding clamp 30 can be manufactured directly from a planar composite sheet by reshaping. Holding clamp 30 then enables inherent component damping in order to enable the insulating effect. This makes possible an acoustically completely decoupled connection between fuel injection valve 3 and cup 9 of fuel distributor 3.

Figure 5:
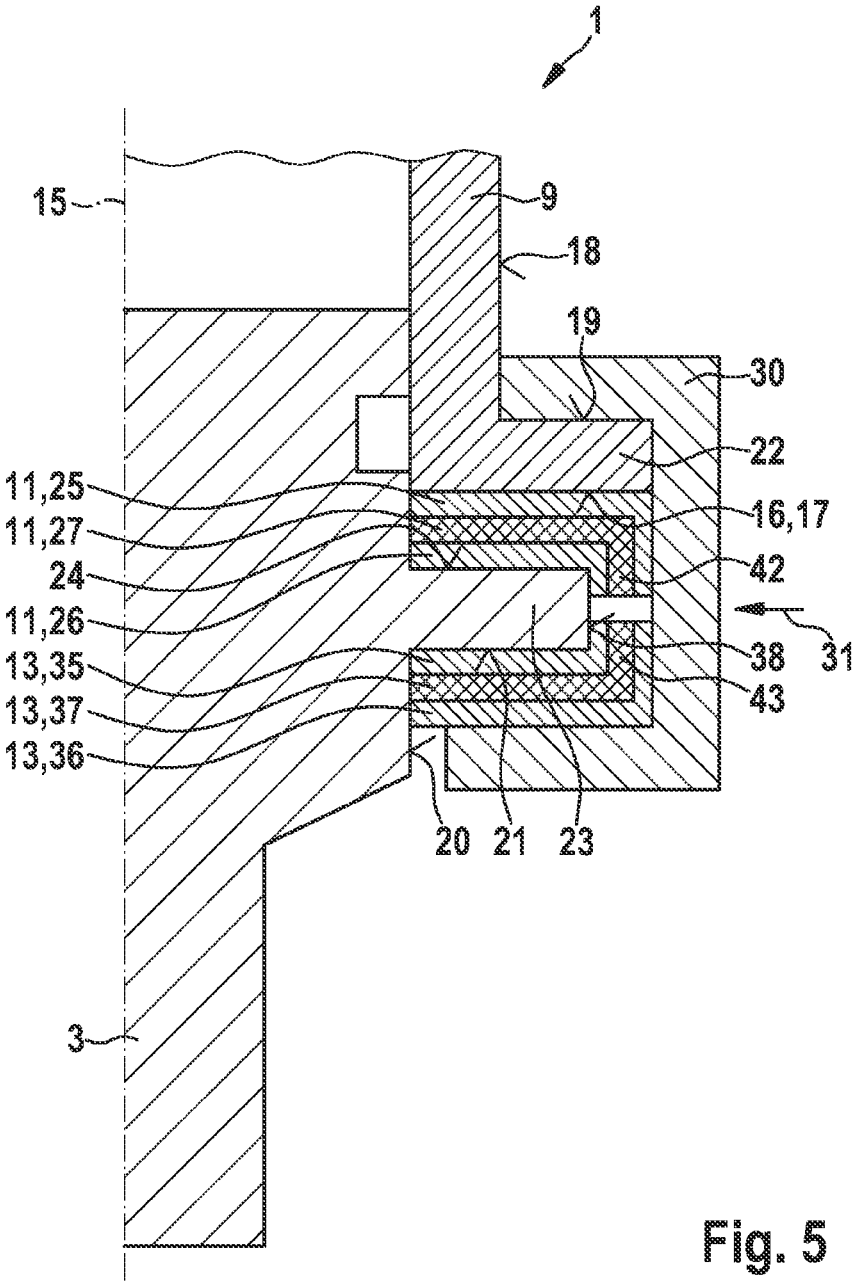
FIG. 5 shows the portion depicted in FIG. 2 of an assemblage in accordance with a third exemplifying embodiment of the invention.

FIG. 5 shows the portion depicted in FIG. 2 of an assemblage 1 in accordance with a fourth exemplifying embodiment. In this exemplifying embodiment composite damping element 11 has a bent outer segment 42 that fits around outer side 38 of collar 23. The bent outer segments 42, 43 of composite damping elements 11, 13 ensure a spacing between holding clamp 30 and outer side 38 of collar 23. A radial decoupling between fuel injection valve 3 and holding clamp 30 is thus ensured even in the case of a direct abutment of holding clamp 30 against the bent outer segments 42, 43 of composite damping elements 11, 13 and of the bent outer segments 42, 43 against outer side 38 of collar 23. This ensures an acoustically completely decoupled connection between fuel injection valve 3 and cup 9.

Composite damping elements 11, 12, 13 each have at least one metal layer 25, 26 and at least one damping layer 27. A preferred configuration is made up of exactly two metal layers 25, 26 and one damping layer 27 disposed therebetween. The preferred configuration is also advantageous for the configuration of holding clamp 30 as described with reference to FIG. 4. Further possible configurations of composite damping elements 11, 12, 13 and/or of holding clamp 30 are described below with reference to FIGS. 6 to 8. Suitable deformations, in particular suitable bends, are possible in this context.

Figure 6:
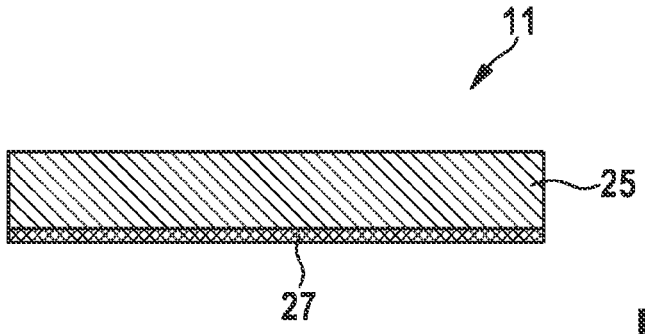
FIG. 6 is a schematic sectioned depiction of a composite damping element for the assemblage depicted in FIG. 1, in accordance with a fifth exemplifying embodiment of the invention.

FIG. 6 is a schematic sectioned depiction of a composite damping element 11 for assemblage 1 in accordance with a fifth embodiment. In this exemplifying embodiment composite damping element 11 is made up of a metal layer 25 and a damping layer 27. Damping layer 27 can be associated, for example, with support surface 24 of collar 23 or with support surface 17 of cup 9.

Figure 7:
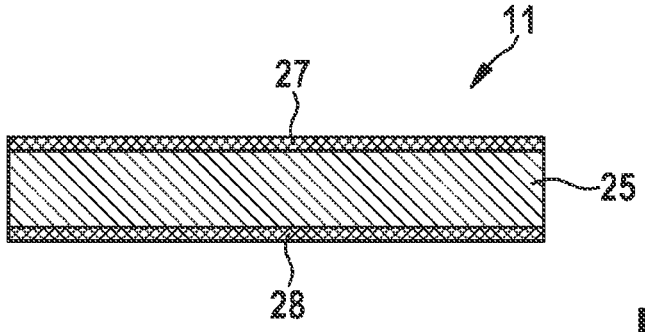
FIG. 7 is a schematic sectioned depiction of a composite damping element for the assemblage depicted in FIG. 1, in accordance with a sixth exemplifying embodiment of the invention.

FIG. 7 is a schematic sectioned depiction of a composite damping element 11 in accordance with a sixth exemplifying embodiment. In this exemplifying embodiment composite damping element 11 is embodied from a metal layer 25 and damping layers 27, 28. In this exemplifying embodiment, metal layer 25 is disposed between damping layers 27, 28. The result is that damping layers 27, 28 serve as external damping layers 27, 28. This makes possible advantageous adaptation to the contact partners, and optionally tolerance compensation.

Figure 8:
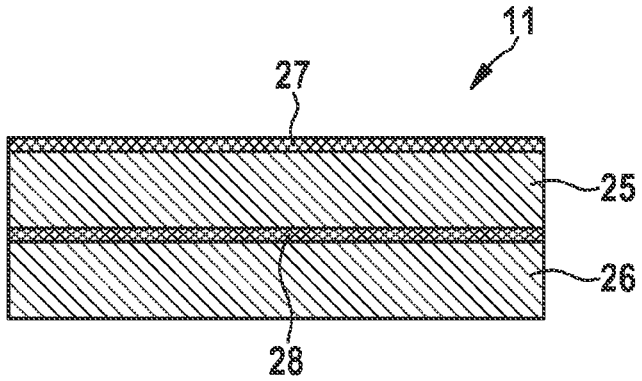
FIG. 8 is a schematic sectioned depiction of a composite damping element for the assemblage depicted in FIG. 1, in accordance with a sixth exemplifying embodiment of the invention.

FIG. 8 is a schematic sectioned depiction of a composite damping element 11 in accordance with a seventh exemplifying embodiment. In this exemplifying embodiment composite damping element 11 is made up of metal layers 25, 26 and damping layers 27, 28. Damping layer 27 serves here as an external damping layer 27. Metal layer 25 is disposed between damping layers 27, 28 and serves as an internal metal layer 25. Damping layer 28 is disposed between metal layers 25, 26 and serves as an internal damping layer 28. Metal layer 26 serves as an external metal layer 26. Damping layer 27 can be associated, for example, with support surface 24 of collar 23 or with support surface 17 of cup 9. A four-ply configuration is thus possible with the exemplifying embodiment described with reference to FIG. 8.

A multiple-ply configuration of holding clamp 30 can also be implemented in corresponding fashion. Also possible are configurations of composite damping elements 11, 12, 13 and/or of holding clamp 30 made up of five or more plies, in which metal layers and damping layers alternate.

Substantial advantages can thereby be achieved, depending on the configuration. Partial or complete decoupling of fuel injection valves 3, 4 from fuel distributor 2 is possible. This yields a considerable reduction in solid-borne sound transfer into fuel distributor 2 and thus into attachment structure 5, while at the same time meeting requirements in terms of function and strength.

Noise emissions from fuel distributor 2 thus decrease.

In addition, a comparatively stiff attachment of fuel injection valves 3, 4 can be achieved despite the decoupling. This is because the flexibility of fuel injection valves 3, 4 relative to cups 9, 10 increases only slightly, so that all functional requirements, in particular little relative movement of fuel injection valves 3, 4, and strength requirements, in particular with regard to wear on a sealing O-ring, are met. At the same time, acoustic, functional, and strength requirements that arise from the design of fuel injection valves 3, 4 and of fuel distributor 2 can thereby be met.

Damping layers 27, 28, 37, 41 can be constituted in particular from an elastomer, and connected to metal layers 25, 26, 35, 36, 39, 40 by vulcanization. Connection by vulcanization is especially possible. In addition, an internal damping layer 27 such as the one described inter alia with reference to FIG. 4 can be reliably protected from abrasion and other environmental influences. The assembly outlay is also low, since composite damping elements 11, 12, 13 merely need to be set in place before fuel injection valves 3, 4 are assembled, and holding clamp 30 can be clipped on in assembly direction 31.

The properties of damping layers 27, 28, 37, 41 can be adapted in terms of certain optimization parameters by way of the thickness and/or material properties. Optimization parameters that can be employed are principally the frequency components to be damped, and temperature.

The properties of an external damping layer 27, 28, as described inter alia with reference to FIGS. 6 and 7, can furthermore be influenced by way of a geometrical conformation. In particular, a profiling or microprofiling can be provided on an external damping layer 27, 28. For example, outwardly directed knobs can be provided. The damping effect can optionally be further enhanced thereby.

Composite damping elements 11, 12, 13 can be configured as annular or partially annular composite damping elements 11, 12, 13. In the case of a partially annular configuration, multiple composite damping elements can also be provided in a manner distributed over the circumference. Multiple holding clamps that correspond to holding clamp 30 can also be correspondingly provided over the circumference.

The invention is not limited to the exemplifying embodiments described.

What is claimed is:

1. A fuel injection system for high-pressure injection in an internal combustion engine, comprising:

a fuel distributor;

a plurality of fuel injection valves, each of the fuel injection valves being disposed on an associated cup of the fuel distributor;

at least one holding element to mount at least one of the fuel injection valves on the associated cup; and at least one composite damping element disposed between the fuel injection valve and the cup;

wherein:

a first abutment surface is provided on an outer side of the cup, and a first support surface is configured on an underside of the cup;

an at least partially annular collar is configured on the fuel injection valve, at which collar a second abutment surface on an outer side of the fuel injection valve is configured;

the holding element is configured as a holding clamp engaging on the one hand behind the first abutment surface of the cup and on the other hand behind the second abutment surface of the fuel injection valve and pushing the fuel injection valve toward the first support surface of the cup; and the at least one composite damping element is disposed between the fuel injection valve and the first support surface of the cup to prevent contact between the fuel injection valve and the first support surface of the cup, wherein the at least one composite damping element has a bent outer segment which fits around an outer side of the collar.

2. The fuel injection system as recited in claim 1, wherein the first abutment surface of the cup and the second abutment surface of the fuel injection valve face away from one another.

3. The fuel injection system as recited in claim 2, wherein an at least partially annular setback of the cup is configured on the outer side of the cup, at which setback the first abutment surface of the cup is configured.

4. The fuel injection system as recited in claim 1, wherein the at least one composite damping element is configured as an at least partially annular composite damping element.

5. The fuel injection system as recited in claim 1, wherein the holding clamp includes a composite sheet having at least one metal layer and at least one damping layer.

6. The fuel injection system as recited in claim 1, wherein the at least one composite damping element has at least one metal layer and at least one damping layer.

7. The fuel injection system as recited in claim 1, wherein the holding element is separate from the at least one composite damping element.

8. The fuel injection system as recited in claim 1, wherein the first abutment surface of the cup and the support surface of the cup face away from one another.

9. The fuel injection system as recited in claim 1, wherein the at least one composite damping element has a first metal layer abutting the support surface of the cup.

10. The fuel injection system as recited in claim 9, wherein the at least one composite damping element has a damping layer abutting the first metal layer.

11. The fuel injection system as recited in claim 10, wherein the at least one composite damping element has a second metal layer abutting the damping layer.

12. The fuel injection system as recited in claim 1, wherein the at least one composite damping element has a first metal layer, a damping layer abutting the first metal layer, and a second metal layer abutting the damping layer.

13. A fuel injection system for high-pressure injection in an internal combustion engine, comprising:

a fuel distributor; and a plurality of fuel injection valves, each of the fuel injection valves being disposed on an associated cup of the fuel distributor, and at least one of the fuel injection valves being mounted on the associated cup by way of at least one holding element;

wherein:

a first abutment surface is provided on an outer side of the cup;

a support surface is configured on an underside of the cup;

the holding element is configured as a holding clamp;

an at least partially annular collar protrudes from a side of the fuel injection valve, at which collar a second abutment surface is provided on an outer side of the fuel injection valve and a second support surface is provided on the fuel injection valve facing toward the support surface of the cup;

the holding clamp engages on the one hand behind the first abutment surface of the cup and on the other hand behind the second abutment surface of the fuel injection valve and pushes the fuel injection valve toward the support surface; and at least one planar composite damping element is disposed between the second support surface of the fuel injection valve and the support surface of the cup to prevent contact between the fuel injection valve and the support surface of the cup; and wherein multiple composite damping elements are provided, and wherein a first of the composite damping elements is disposed between the fuel injection valve and the support surface of the cup, and a second of the composite damping elements is disposed between the second abutment surface of the fuel injection valve and the holding clamp.

14. The fuel injection system as recited in claim 13, wherein the planar composite damping element projects beyond an outer side of the collar.

15. A fuel injection system for high-pressure injection in an internal combustion engine, comprising:

a fuel distributor;

a plurality of fuel injection valves, each of the fuel injection valves being disposed on an associated cup of the fuel distributor;

at least one holding element to mount at least one of the fuel injection valves on the associated cup;

a first composite damping element disposed between the fuel injection valve and the cup, and a second damping element;

wherein:

a first abutment surface is provided on an outer side of the cup, and a support surface is configured on an underside of the cup;

a second abutment surface is provided on an outer side of the fuel injection valve;

the holding element is configured as a holding clamp engaging on the one hand behind the first abutment surface of the cup and on the other hand behind the second abutment surface of the fuel injection valve and pushing the fuel injection valve toward the support surface of the cup;

the first composite damping element is disposed between the fuel injection valve and the support surface of the cup to prevent contact between the fuel injection valve and the support surface of the cup; and the second damping element is disposed between the second abutment surface of the fuel injection valve and the holding clamp.

* * * * *